US005102101A

United States Patent [19]

Smyth et al.

[11] Patent Number: 5,102,101

[45] Date of Patent: Apr. 7, 1992

[54] STRAND TENSIONING TOOL

[75] Inventors: Laurence C. Smyth, Beaconsfield; Eduardo Del Rincon, Pierrefonds, both of Canada

[73] Assignee: Wire Rope Industries Ltd., Pointe-Claire, Canada

[21] Appl. No.: 517,198

[22] Filed: May 1, 1990

[30] Foreign Application Priority Data

May 4, 1989 [CA] Canada ..... 598727

[51] Int. Cl.[5] ..... B65H 59/00

[52] U.S. Cl. ..... 254/213

[58] Field of Search ..... 242/125.1, 125.2; 254/213, 216, 262, 405

[56] References Cited

U.S. PATENT DOCUMENTS

| | | | |
|---|---|---|---|
| 535,633 | 3/1895 | Stere | 254/213 |
| 577,617 | 2/1897 | Hendricks | 254/213 X |
| 633,632 | 9/1899 | Wilson | 254/213 X |
| 733,239 | 7/1903 | Maddox | 254/405 |
| 3,048,204 | 8/1962 | Lingle | 254/213 |
| 3,125,326 | 3/1964 | Ericsson | 254/216 |
| 3,353,793 | 11/1967 | Nelson | 254/333 |
| 3,360,017 | 12/1967 | Vilcins | 254/216 X |

*Primary Examiner*—Katherine Matecki

*Attorney, Agent, or Firm*—Fleit, Jacobson, Cohn, Price, Holman & Stern

[57] ABSTRACT

A strand tensioning tool comprises a tool body, a stationary clamp mounted on the tool body for holding one end of the strand and including a fixed plate secured to the tool body and a gripper plate pivotally mounted on the tool body using two parallel levers for allowing even distribution of clamping stress over a predetermined length of strand, a rotary drum also mounted on the tool body and having a notch across the face thereof for inserting the other end of the strand to tension the strand around packages to be strapped by rotation of the drum, and a guide plate rotatably mounted on the tool body and adapted to trap the strand in the notched drum to prevent it from sliding out of the drum during rotation of the drum.

6 Claims, 2 Drawing Sheets

STRAND TENSIONING TOOL

Figure 1:
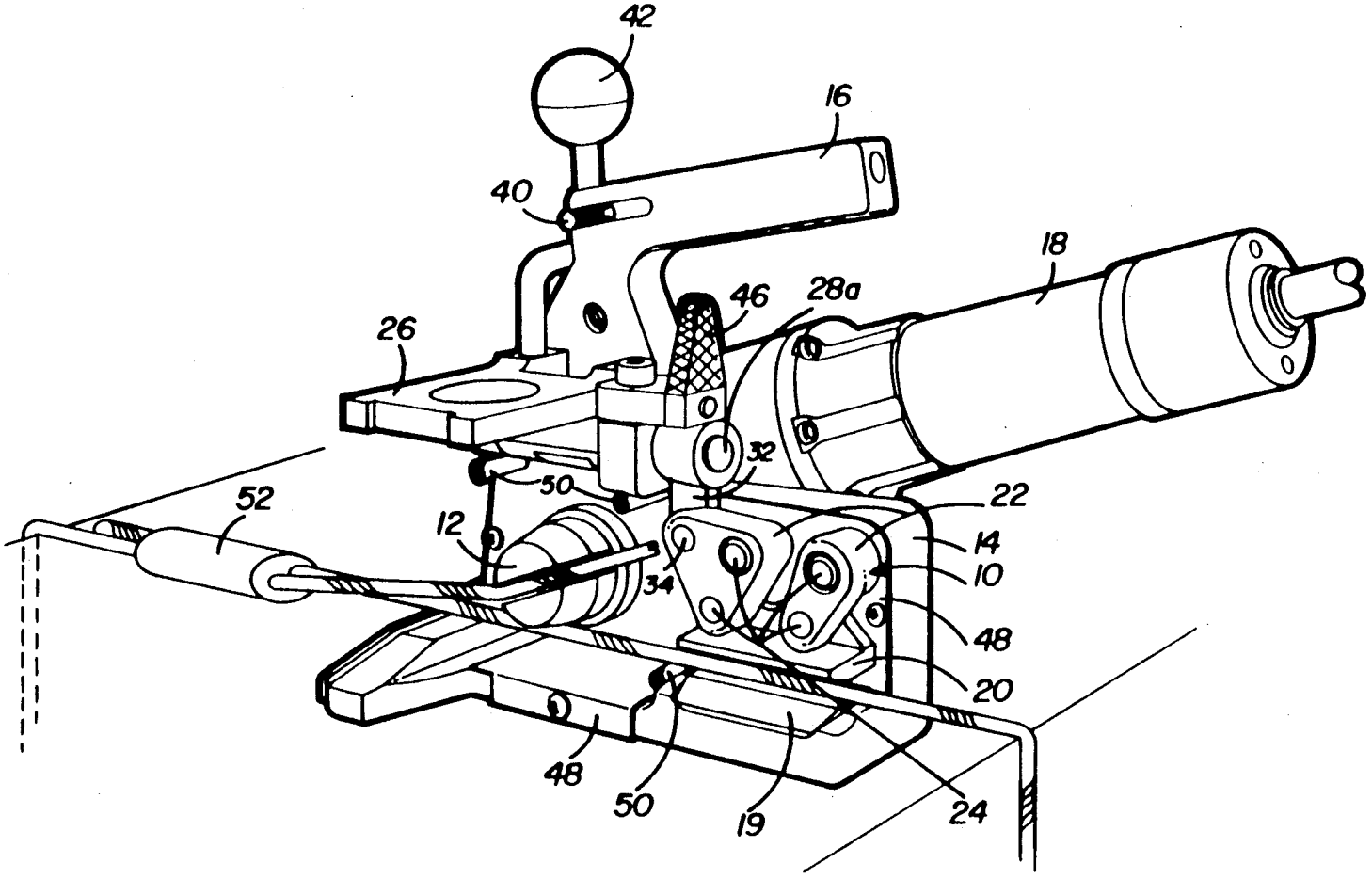

This invention relates to a tool for tensioning a flexible wire strand around packages.

In particular applications, such as lumber packaging, it may be desirable to use a wire strand instead of a conventional band for strapping packages. However, the band provides a wide flat surface to grip at one end and a surface which can be stably wound on itself at the other end to tension the band around the package. The wire strand is just the opposite, i.e. the simple gripper wheel which is normally used on a conventional band tensioning tool can only contact a very small percentage of the strand surface and minimal tension can thus be developed without damaging the strand due to excessive localized stress. Similarly, if a simple notched drum is used to tension the strand, as it is normally used in known band tensioning tools, the strand will not stack on itself to clamp it on the drum and the strand will thus slide out of the drum. Therefore, conventional band tensioning tools cannot be used to tension wire strands around packages.

It is therefore the object of the present invention to provide a new strand tensioning tool which allows positive gripping of the strand at one end and positive tensioning of the other end of the strand around the package to be strapped.

The strand tensioning tool comprises a tool body, a stationary clamp mounted on the tool body and including means for allowing even distribution of clamping stress over a predetermined length of strand for holding one end of the strand, a rotary drum also mounted on the tool body and having a notch across the face thereof for inserting the other end of the strand to tension the strand around packages to be strapped by rotation of the drum, and a guide plate pivotally mounted on the tool about an axis perpendicular to the axis of the drum body and adapted to close the end of the drum to trap the strand in the notched drum to prevent it from sliding out of the drum during rotation of the drum.

The stationary clamp preferably comprises a fixed plate secured to the tool body, a gripper plate, two parallel levers each pivotally mounted at one end around a first axle located on the tool body and at the other end around a second axle located on the gripper plate, each axle being positioned at the respective corners of a parallelogram for parallel movement of the gripper plate with respect to the fixed plate.

The fixed plate is preferably smooth whereas the gripper plate is serrated for gripping the wire strand.

One of the levers of the stationary clamp is preferably coupled to the guide plate through an eccentric or other means whereby pivotal of the guide plate to trap the strand in the notched drum simultaneously operates the stationary clamp to grip one end of the strand.

A carrying handle is provided on the tool body for holding the tool and a first latch mechanism is mounted on the handle for holding the guide plate in open position for threading of the strand through the tool.

A second latching mechanism is mounted on the tool body to lock the guide plate in closed position.

Figure 2:
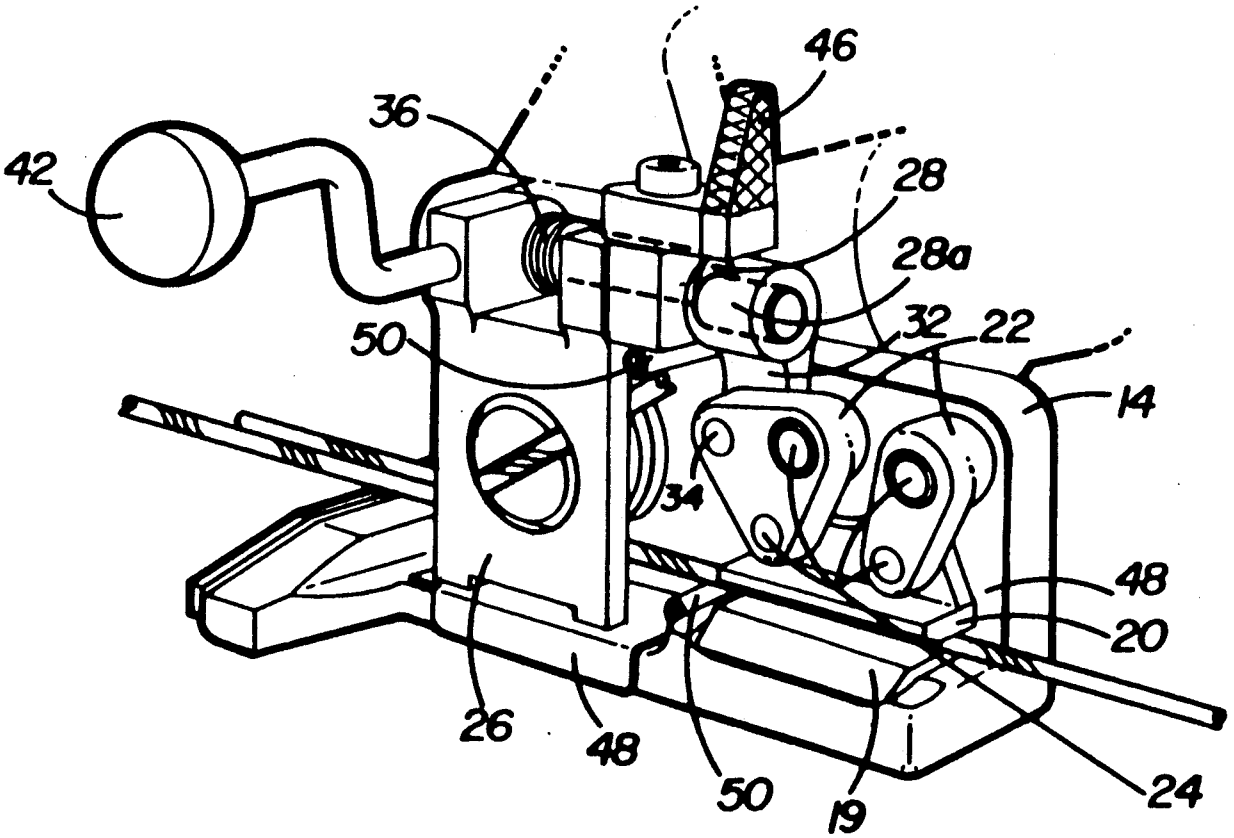

The invention will now be disclosed, by way of example, with reference to the accompanying drawings in which FIGS. 1 and 2 illustrate a preferred embodiment of a strand tensioning tool.

Referring to FIG. 1 of the drawings, there is shown a tool comprising a stationary clamp designated generally by reference numeral 10 and a notched rotary drum 12 mounted on a tool body 14. A carrying handle 16 is mounted on the tool body for holding the tool. The rotary drum is shown as being operated by an air motor 18 although it could possibly be operated by a hydraulic motor or any suitable hand operated ratchet assembly.

The stationary clamp comprises a fixed plate 19 secured to the tool body and a gripper plate 20 which is mounted on the tool body by means of two parallel levers 22 each adapted to be pivotally mounted on equally spaced axles 24 located one on the tool body and the other on the gripper plate. The two axles on the tool body are also spaced by the same distance as the axles on the gripper plate so that each axle is located at the respective corners of a parallelogram.

A guide plate 26 is fixed on a shaft 28 which is pivotally mounted on the tool body. As shown in FIG. 2 shaft 28 has an eccentric portion 28*a* which engages an operating lever 32 connected to an axle 34 on one of the levers 22. A torsion spring 36 is mounted on the shaft so as to bias the gripper plate 20 sufficiently to trap one end of the strand between the gripper plate and the fixed plate. A latching mechanism operated by a lever 40 is provided on the holding handle 16 for locking the guide plate open prior to insertion of the wire strand into the tool. A ball knob 42 is provided on the guide plate and when such ball knob is moved downwardly, the operating lever fully sets the gripper plate. A second latching mechanism operated by a lever 46 is mounted on the tool body for locking the guide plate in closed position prior to rotation of the rotary drum to tension the strand.

The tool body is preferably made of aluminum to reduce weight and the portions of the tool body adapted to contact the wire strand are protected by a steel plate 48. Steel posts 50 are also provided on the tool body for protecting the aluminum body from damage by the wire strand.

The tool is normally used to tension goods which have a pre-applied strand and seal, that is the strand is wrapped around the goods and each free end is threaded through an aluminum seal 52 as shown in FIG. 1. The excess looseness is then pulled out and each strand is slightly bent away from the seal to prevent the strand slipping out of the seal. The tool is normally in the ready to load position from the last tensioning cycle, that is the guide plate is latched open which also opens the stationary gripper. The tool is then slid under the strand trapping the strand in the stationary gripper. The strand free end is then grabbed by the operator's left hand and pulled into the pre-aligned slot of the split drum. Releasing the latch operated by lever 40 then allows the spring biased guide plate to trap the strand free end and load the stationary gripper. A push on the ball then positively locks the two strand grippers with the latch operated by lever 46. The air motor 18 is energized to rotate the rotary drum and tension the wire strand around the package. When sufficient tension is applied, the motor is stopped and the seal is applied to lock the wire strand around the package. Pushing lever 46 then releases the latch and allows the guide plate to be pulled open as the tool is clamped to the package by the tensioned and sealed strand. This releases the stationary gripper and allows the guide plate and associated mechanism latched open. Sliding the tool from under the strand then completes the cycle.

Although the invention has been disclosed by way of example with reference to a preferred embodiment, it is to be understood that other alternatives are also envisaged within the scope of the following claims. Furthermore, the strand tensioning tool could additionally be provided with a strand cutting device or a strand sealing device.

We claim:

1. A strand tensioning tool comprising:

a) a tool body;

b) a stationary clamp mounted on the tool body for holding one end of the strand and including means for allowing even distribution of clamping stress over a predetermined length of strand;

c) a rotary drum also mounted on the tool body and having a notch across the face thereof for inserting the other end of the strand to tension the strand around packages to be strapped by rotation of the drum;

d) a guide plate pivotally mounted on the tool body about an axis perpendicular to the axis of the drum and adapted to close the end of the drum to trap the strand in the notched drum to prevent it from sliding out of the drum during rotation of the drum;

e) an operating handle secured to said guide plate for pivoting the guide plate; and f) means for coupling said guide plate to said stationary clamp whereby pivotal movement of said guide plate by the operating handle to trap the strand also results in operation of the stationary clamp.

2. A strand tensioning tool as defined in claim 1, wherein said stationary clamp comprises a first fixed plate secured to the tool body, a gripper plate, two parallel levers each pivotally mounted at one end around a first axle located on the tool body and at the other end around a second axle located on the gripper plate, each axle being positioned at the respective corners of a parallelogram for parallel movement of the gripper plate with respect to the fixed plate.

3. A strand tensioning tool as defined in claim 2, wherein said fixed plate is smooth and wherein said gripper plate is serrated for gripping the wire strand.

4. A strand tensioning tool as defined in claim 2, wherein one of the levers of the stationary clamp is coupled to the guide plate whereby rotation of the guide plate results in operation of the stationary clamp to grip one end of the strand.

5. A strand tensioning tool as defined in claim 1, further comprising a carrying handle mounted on the tool body for holding the tool and a first latching mechanism mounted on the carrying handle for holding the guide plate in open position during threading of the strand through the tool.

6. A strand tensioning tool as defined in claim 1, further comprising a second latching mechanism mounted on the tool body to lock the guide plate in closed position during rotation of the drum.

* * * * *